US011365025B2

(12) United States Patent
Birnstihl

(10) Patent No.: US 11,365,025 B2
(45) Date of Patent: Jun. 21, 2022

(54) PALLET COVER AND TRANSPORT CONTAINER

(71) Applicant: Charles Birnstihl, Apopka, FL (US)

(72) Inventor: Charles Birnstihl, Apopka, FL (US)

( * ) Notice: Subject to any disclaimer, the term of this patent is extended or adjusted under 35 U.S.C. 154(b) by 134 days.

(21) Appl. No.: 16/422,732

(22) Filed: May 24, 2019

(65) Prior Publication Data

US 2020/0369434 A1 Nov. 26, 2020

(51) Int. Cl.
*B65D 19/38* (2006.01)

(52) U.S. Cl.
CPC .... *B65D 19/385* (2013.01); *B65D 2519/0086* (2013.01); *B65D 2519/00208* (2013.01); *B65D 2519/00711* (2013.01); *B65D 2519/00965* (2013.01)

(58) Field of Classification Search
CPC ..... B65D 19/385; B65D 19/06; B65D 2519/00154; B65D 2519/00159; B65D 2519/00164; B65D 2519/174; B65D 2519/179; B65D 2519/00184; B65D 2519/00189; B65D 2519/00194; B65D 2519/00492; B65D 2519/00218; B65D 2519/00213; B65D 2519/00208; B65D 2519/00636; B65D 2519/00661; B65D 2519/00706; B65D 2519/00199; B65D 2519/0071; B65D 2519/0086; B65D 2519/00965
USPC ..... 206/386, 595, 596, 598, 600
See application file for complete search history.

(56) References Cited

U.S. PATENT DOCUMENTS

| | | | | | |
|---|---|---|---|---|---|
| 4,030,600 | A * | 6/1977 | Heaps | B65D 19/20 | 206/597 |
| RE35,875 | E * | 8/1998 | Shuert | 108/55.1 | |
| 5,829,616 | A * | 11/1998 | Daniel | B65D 19/08 | 220/4.03 |
| 6,024,223 | A * | 2/2000 | Ritter | B65D 19/18 | 206/386 |
| 7,331,453 | B2 * | 2/2008 | Burra | B65D 85/68 | 206/319 |
| 8,146,771 | B1 * | 4/2012 | Segeleon | B65D 19/18 | 220/495.06 |
| 10,759,588 | B1 * | 9/2020 | Lobisser | B65D 19/02 | |
| 10,812,029 | B2 * | 10/2020 | Nomura | H03F 3/45269 | |
| 10,882,663 | B2 * | 1/2021 | Hartl | B65D 19/38 | |
| 2008/0179320 | A1 * | 7/2008 | Abel | B65D 19/20 | 108/55.3 |
| 2012/0181214 | A1 * | 7/2012 | Kernen | B65F 1/02 | 206/596 |

(Continued)

*Primary Examiner* — Chun Hoi Cheung
(74) *Attorney, Agent, or Firm* — Jason T. Daniel, Esq.; Daniel Law Offices, P.A.

(57) ABSTRACT

A pallet cover and transport container includes a container body having a top end, a plurality of side walls, and an interior space. The bottom end of the container is open to the interior space and includes complementary dimensions to a shipping pallet. A first plurality of grooves are disposed along the bottom end of the side walls at locations complementary to the side channels of the shipping pallet. Connectors are disposed along the side walls to removably secure the container to a pallet. The connectors including a sliding shaft having an aperture for receiving a lock. A second plurality of grooves are disposed along the closed top end of the container body to allow the container to be used while inverted and transported by a forklift.

14 Claims, 7 Drawing Sheets

(56) References Cited

U.S. PATENT DOCUMENTS

| | | | | |
|---|---|---|---|---|
| 2012/0267284 | A1* | 10/2012 | Thimmesch | B65D 71/0096 206/597 |
| 2013/0014676 | A1* | 1/2013 | Imbrecht | B65D 90/00 108/57.25 |
| 2014/0083896 | A1* | 3/2014 | Park | B65D 21/083 206/503 |
| 2019/0202614 | A1* | 7/2019 | Unruh | B65D 71/0096 |
| 2020/0118065 | A1* | 4/2020 | Li | G06Q 10/087 |
| 2020/0231333 | A1* | 7/2020 | Holm | B65D 19/38 |

* cited by examiner

PALLET COVER AND TRANSPORT CONTAINER

TECHNICAL FIELD

The present invention relates generally to shipping containers, and more particularly to a reusable pallet container.

BACKGROUND

The statements in this section merely provide background information related to the present disclosure and may not constitute prior art.

Companies who manufacture items for use in commerce typically package and ship the items on pallets. In many instances, the packaging procedure is done completely or partially by machines who stack any number of boxes onto a commercial shipping pallet and then shrink-wrap the same. Owing to this automation, the dimensions of the ready-to-ship pallets produced by many companies are identical week in and week out.

Shipping pallets are typically constructed from wood or plastic, and most commonly include a dimension of 48×40 inches. The pallets having a top surface onto which goods are stacked, and a plurality of channels along the sides for receiving the arms of a forklift. Although this method has proved useful for moving groups of items at one time, there are several practical and environmental drawbacks.

One of the major disadvantages to this method is that the pallet contents are easily damaged during transport. The most common cause of damage results from forklifts or other machinery while moving the palletized materials from one location to another. Many times, the forks inadvertently puncture the plastic wrap and damage or destroy the palletized contents. Moreover, because there is no structural support other than the pallet itself, there is no way to stack full pallets of materials vertically, so as to utilize all available space in a trailer or other transport vehicle.

Another issue is that pallets are often loaded onto vehicles or aircraft outdoors, where adverse weather conditions such as rain or snow are present. In such situations, moisture enters the open top end of the pallet where it penetrates the cardboard shipping boxes and damages the box contents. Finally, in an attempt to make it more difficult for a thief to cut the plastic and steel palletized goods, shippers often over-wrap the pallets using 2-5 times the amount of shrink wrap that would otherwise be necessary. Because plastic shrink wrap can only be used one time, this produces a significant amount of waste that represents serious and ongoing environmental issues affecting landfills and our oceans.

Accordingly, the need exists for a reusable pallet cover and transport container that does not suffer from the above noted deficiencies.

SUMMARY OF THE INVENTION

The present invention is directed to a pallet cover and transport container. One embodiment of the present invention can include a container body having a top end, a plurality of side walls, and an interior space. The bottom end of the container is open to the interior space and includes a dimension that is complementary to a dimension of a shipping pallet.

In one embodiment, a plurality of grooves are disposed along the bottom end of the side walls. Each of the grooves having a shape and location that is complementary to a shape and a location of the channels along the sides of the shipping pallet to receive the forks of a forklift.

Another embodiment of the present invention can include one or more connectors that are disposed along the side walls. The connectors functioning to removably secure the container to a pallet with the pallet contents located inside the container. The connector can include a sliding shaft having an aperture that can receive a lock to prevent opening and separation of the container from the pallet.

Another embodiment of the present invention can include a second plurality of grooves that are disposed along the closed top end of the container body. The second plurality of grooves functioning to allow the container to be used while inverted and transported by a forklift using the second plurality of grooves.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
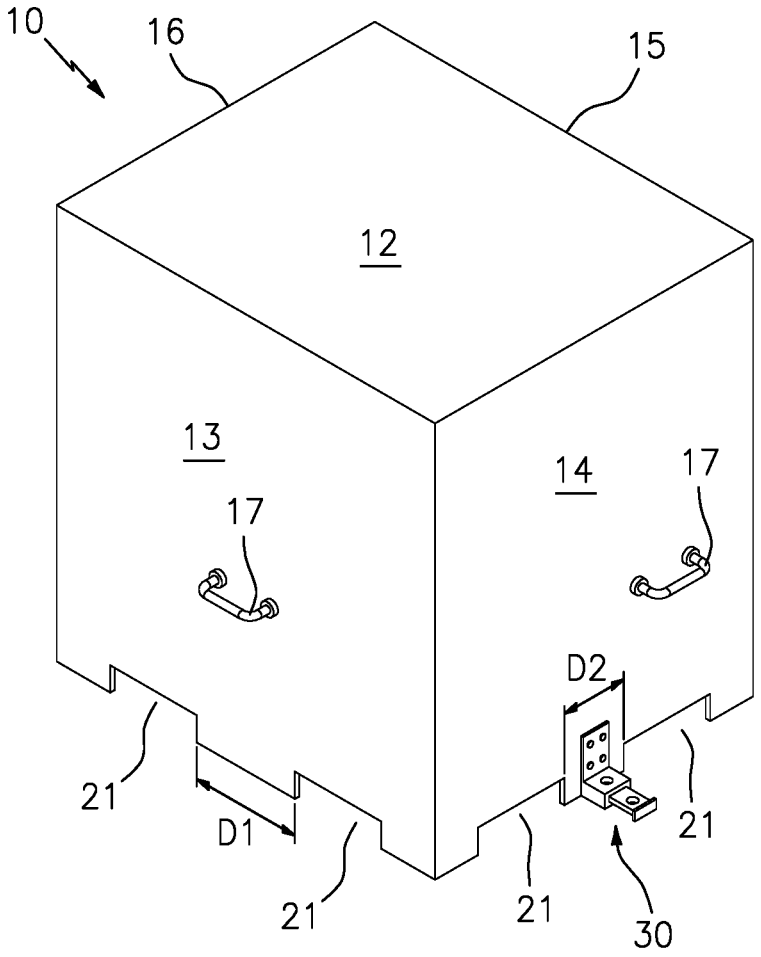
FIG. 1 is a perspective view of a pallet cover and transport container that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material (i.e. Velcro®), magnets, and/or compression fittings such as locking pins, clamps, nut/bolts, tethers (e.g., zip ties), snaps and buttons, for example.

FIGS. 1-7 illustrate one embodiment of a pallet cover and transport container 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
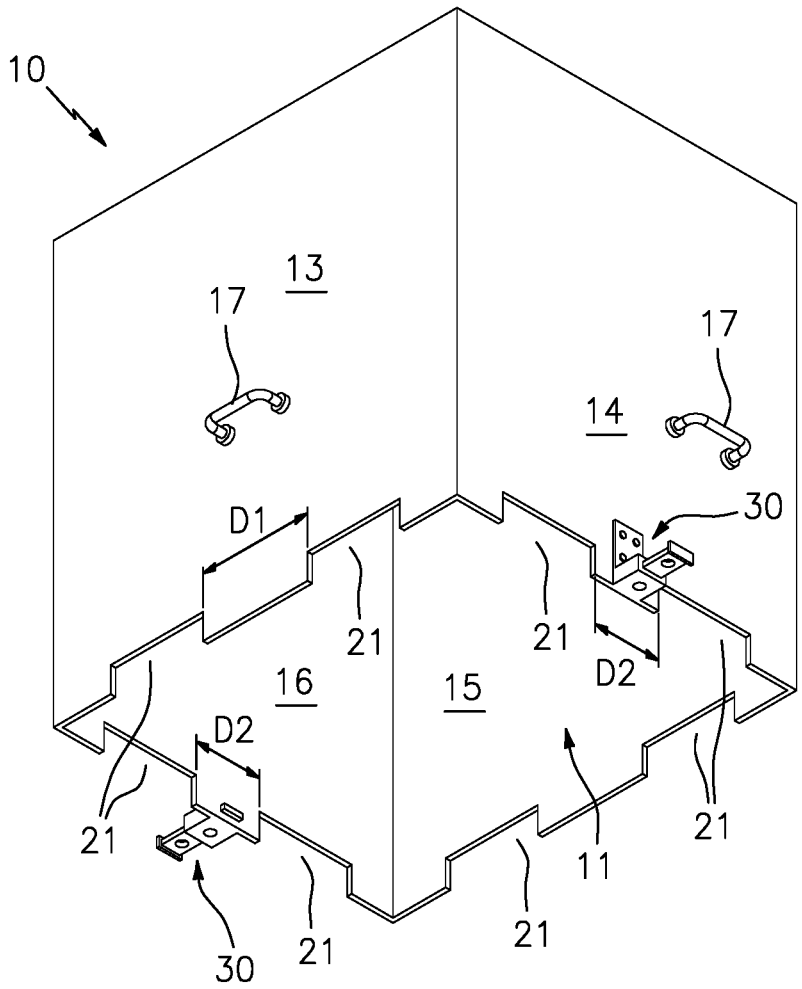
FIG. 2 is a bottom perspective view of the container in accordance with one embodiment of the invention.

As shown in FIGS. 1 and 2, the container 10 can include a generally rectangular-shaped body having an open bottom end 11, a closed top end 12, and a plurality of side walls 13, 14, 15 and 16 that define a hollow interior space. As the container is designed to be used with commercial shipping pallets, the open bottom end 11 will preferably include dimensions that are complementary to the dimensions of a shipping pallet. Optional handles 17 can be provided along the outside of the container to aid in manual lifting of the same.

In various embodiments, the top end 12 of the container 10 can be flat. Owing to the rigid structural support provided by the side and top walls of the container when secured to a pallet, the inclusion of a flat top allows a user to stack a second pallet of material vertically onto the first pallet and container. Such a feature advantageously allows a shipper to utilize all vertical space in a trailer which is typically not able to be utilized.

In other embodiments, the top end of the container can include a pitched or non-flat shape so as to explicitly prevent stacking. Such a feature being particularly advantageous when shipping volatile or hazardous materials, for example. In either instance, any number of channels can be positioned along the main body of each container so as to receive metal strapping bands for securing multiple pallets and/or containers together during transport.

In the preferred embodiment, the side walls can be tapered wherein the dimension of the container along the open bottom end is greater than the dimension of the container along the closed top end 12. Such a feature allowing multiple empty containers to be stacked inside each other so as to reduce the space required to store the containers when not being used.

As described herein, the container 10 can be constructed from any number of different materials and can include any number of different shapes and sizes. In the preferred embodiment, the container can be constructed from recycled plastic so as to be lightweight, resistant to water, and environmentally friendly. In some embodiments, the plastic material may be blended or lined with fire retardant additives so as to be used in the transportation of hazardous materials. In another embodiment, the container can be insulated—either through incorporation of insulation within the plastic construction or by having a cloth blanket liner, for example. The ability to independently insulate an entire pallet of materials advantageously prevents damage to sensitive components that are temperature sensitive.

Of course, other embodiments are contemplated wherein the container may be constructed from other materials that are, for example, relatively strong and stiff for their weight. Several nonlimiting examples include but are not limited to various metals or metal alloys (e.g., aluminum, steel, titanium, or alloys thereof), plastic/polymers (e.g., high-density polyethylene (HDPE), rigid polyvinyl chloride (PVC), or polyethylene terephthalate (PET)), and/or various composite materials (e.g., carbon fibers in a polymer matrix, fiberglass, etc.). Moreover, each container may be manufactured to include any number of different markings or colors, so as to designate the contents or class of contents secured within the container.

In one embodiment, a first plurality of grooves 21 can be positioned along the bottom edges of one or more of the side walls 13-16. Each of the grooves 21 can include complementary dimensions and locations as the channels found on a shipping pallet so as to allow the same to be engaged by the forks of a forklift. To this end, the grooves along side walls 13 and 15 can be separated by a first distance D1, and the grooves along the side walls 14 and 16 can be separated by a second distance D2. Depending on the shape of the container 10, distances D1 and D2 can be identical or different.

Figure 3:
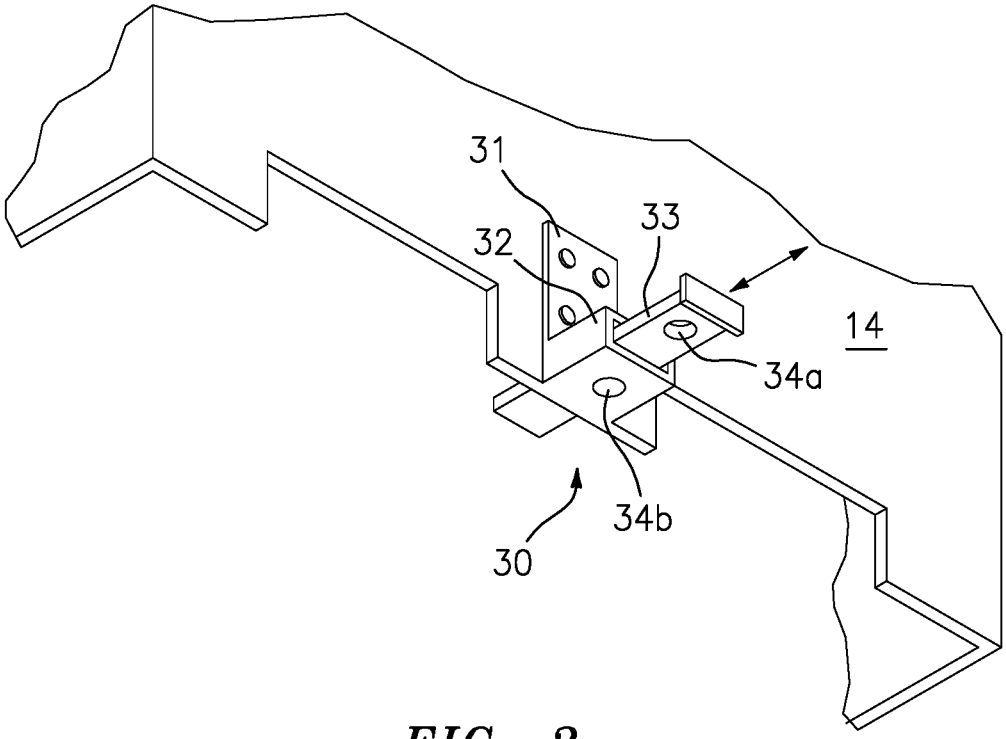
FIG. 3 is a partial cutout view of one side of the container in accordance with one embodiment of the invention.

As shown best in cutout FIG. 3, one embodiment of the container 10 can include one or more connectors 30 that can be positioned along the bottom ends of one or more of the side walls 13-16. In the preferred embodiment, each connector 30 can include a body section 31 that is permanently secured to the wall of the container 10. A hollow channel 32 is positioned along the bottom end of the body, and a planar shaft 33 can slide through the channel. When the shaft is in the closed position (i.e., slid fully into the channel) the shaft body will be positioned under the top surface of the pallet so as to prevent the cover from being removed.

In one embodiment, apertures 34*a* and 34*b* can be positioned along the channel 32 and the shaft 33. When the shaft is in the closed position, the apertures can be aligned so as to receive a lock or other such device thereby preventing the connector from being opened or removed by an unauthorized person. Of course, the container is not limited to the use of any particular type of connector, as any device capable of removably securing the bottom of the container to a pallet is also contemplated.

Figure 4:
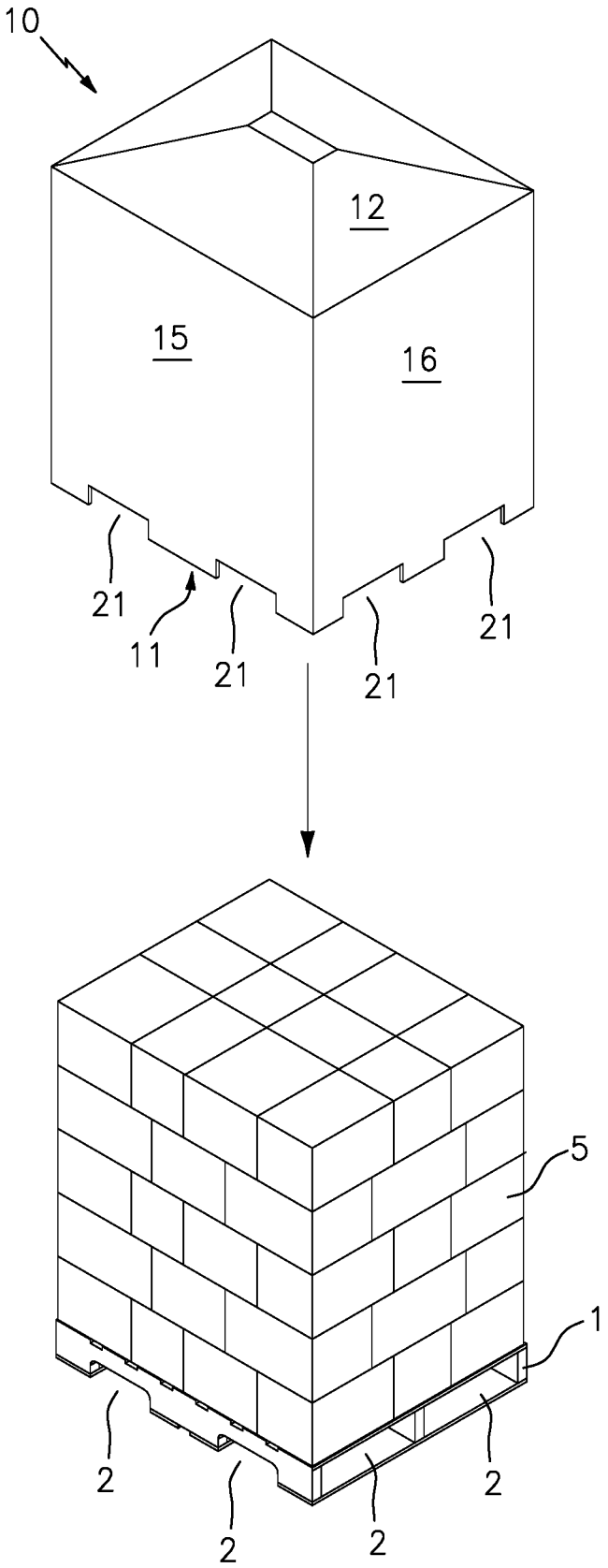
FIG. 4 is a perspective view of the container in operation, in accordance with one embodiment of the invention.
Figure 5:
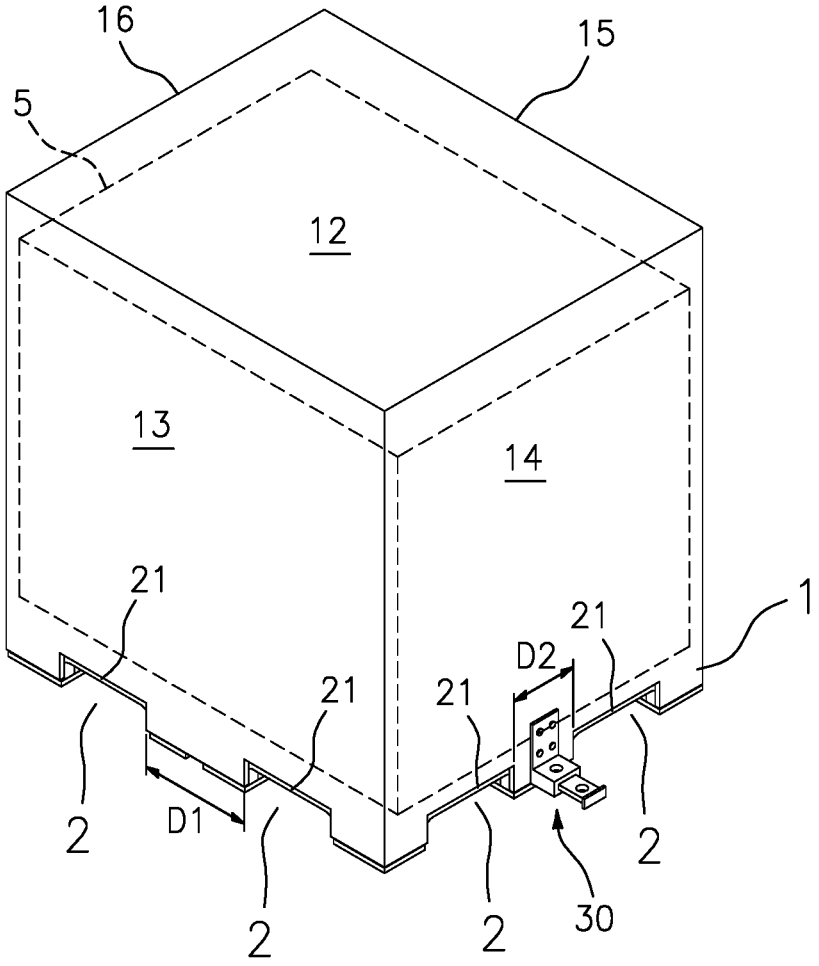
FIG. 5 is another perspective view of the container in operation, in accordance with one embodiment of the invention.

FIGS. 4 and 5 illustrate one embodiment of the container 10 in operation. As shown, a container 10 can be manually lifted and positioned so that the open bottom end 11 is directly above a pallet 1 that is loaded with materials 5. The materials may be stacked onto the pallet without shrink wrap or may include only one layer of shrink wrap.

Next, the container can be lowered over the pallet assembly so that the top 12 and side surfaces 13-16 surround the pallet and materials. When so positioned, each of the grooves 21 will be aligned with the channels 2 of the pallet 1 so that a forklift can be used in the normal manner to lift and move the pallet. Additionally, once the cover is secured onto the pallet, the connector 30 can be locked as described above so as to prevent separation of the cover from the pallet.

Figure 6:
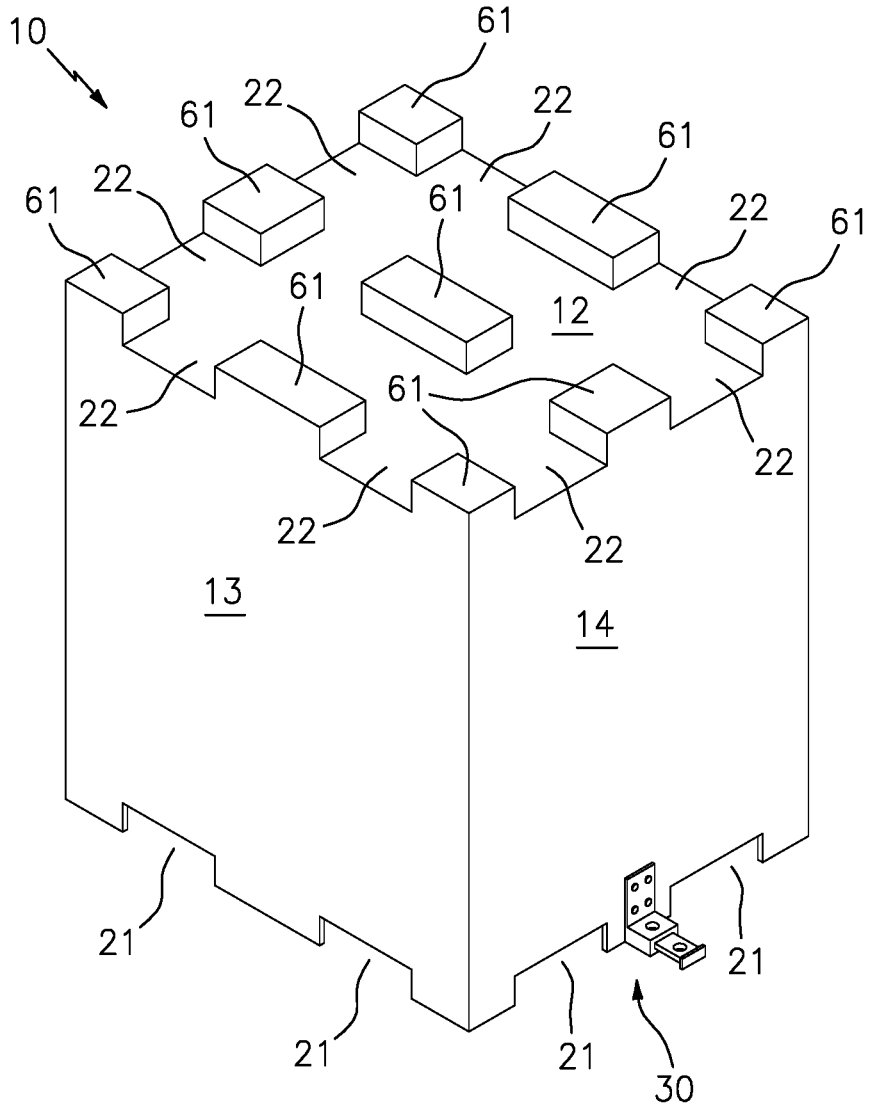
FIG. 6 is a bottom perspective view of the container in accordance with one embodiment of the invention.

FIG. 6 illustrates one embodiment of the container 10 that further includes a plurality of protrusions 61 that are positioned along the closed end 12 of the container. The protrusions forming a second plurality of grooves 22 which can include complementary dimensions and/or locations as the grooves 21 described above. Additionally, grooves 22 can be positioned so as to interlock with grooves 21 when two containers 10 are stacked, thus eliminating the need for the pallet banding described above.

Figure 7:
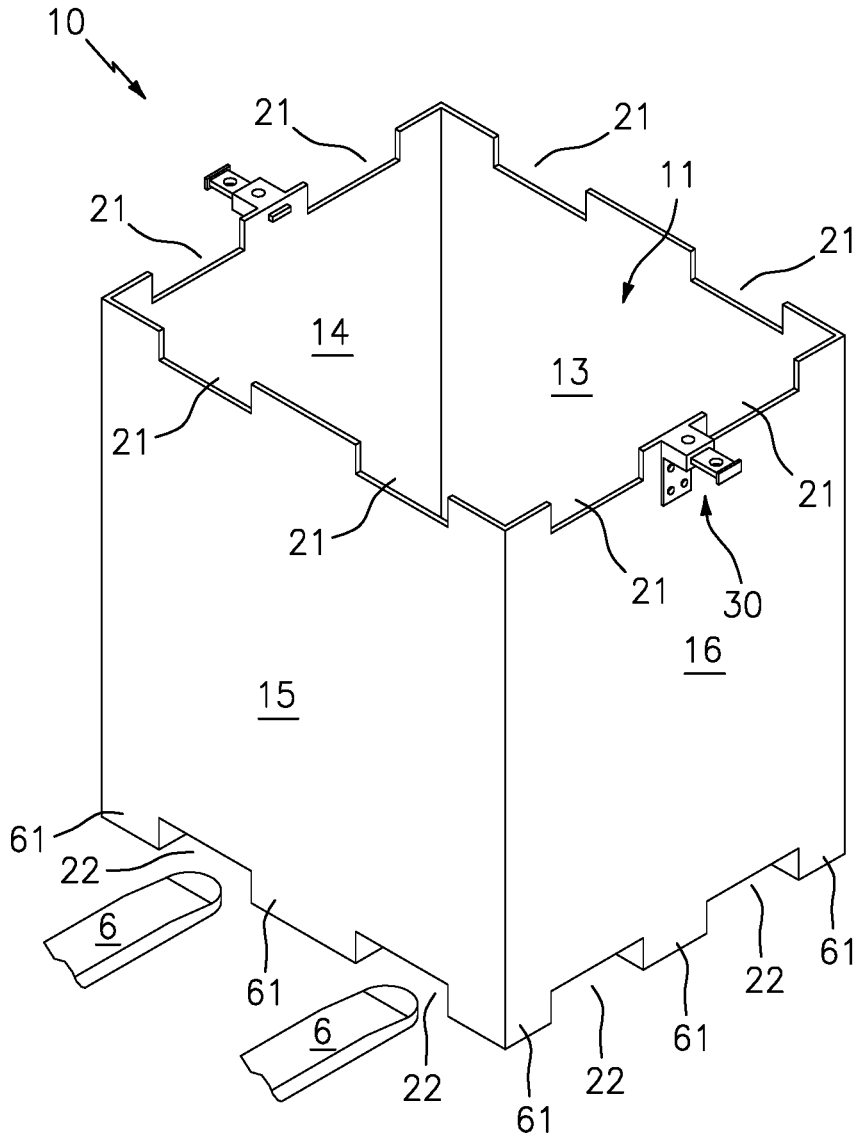
FIG. 7 is a perspective view of the container in an inverted position, in accordance with one embodiment of the invention.

As shown in FIG. 7, the second set of grooves 22 can function to directly receive the forks 6 of a forklift when the container is in an inverted position. Such a feature allowing a shipper to fill the interior portion of the container 10 with any number of different materials so as to utilize the container as a storage or shipping box when not secured to a pallet.

As noted above, the container 10 is designed to be used with palletized materials. As such, in one preferred embodiment, the open bottom end 11 can include a width (e.g., distance between side walls 14 and 16) of 40 inches, and a length (e.g., distance between side walls 13 and 15) of 48 inches, so as to be complementary in shape and size to standard shipping pallets having the same dimensions. Likewise, the height (e.g., distance between elements 11 and 12) of each of the side walls 13-16 can be 60 inches, so as to conform to international freight dimensions of 60 inches. Of course, other embodiments are contemplated wherein the container is manufactured to include dimensions different than those described above. Such features being beneficial for manufacturer of items who routinely ship products having non-conforming dimensions.

Although described above for use with existing shipping pallets, other embodiments are contemplated wherein the container is provided with a new shipping pallet that is constructed for use specifically with the above described container system.

Accordingly, the above noted container advantageously functions to ensure that palletized materials are protected from theft, adverse weather conditions and damage caused from forklifts and other such equipment.

As described herein, one or more elements of the container 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A cover and transport container for use with a shipping pallet, said container comprising:

a container body having a closed top end, a plurality of side walls, an open bottom end and an interior space; and a plurality of grooves that are positioned along a bottom edge of at least one of the side walls; and a plurality of protrusions extending from an outside surface of the closed top end, said plurality of protrusions forming a second plurality of grooves having a location that is complimentary to a location of the plurality of grooves, wherein said second plurality of grooves being configured to receive a forks of a forklift when the cover is in the inverted position, wherein the open bottom end includes a rectangular shape having dimensions that are complementary to a dimension of a shipping pallet, and each of the plurality of grooves include locations that are complementary to a location of a fork channel on the shipping pallet, and wherein the container body includes a unitary construction having functionality for operating in an inverted position wherein a plurality of objects are stored on an inside surface of the closed top end within the interior space.

2. The container of claim 1, further comprising:

at least one connector that is disposed along the container body adjacent to the open bottom end.

3. The container of claim 2, wherein the at least one connector includes functionality for securing the container body to the shipping pallet.

4. The container of claim 3, wherein the at least one connector includes apertures for receiving a lock to lock the container body to the shipping pallet.

5. The container of claim 3, wherein the open bottom end includes a rectangular shape having dimensions that allow the plurality of side walls to cover an outer perimeter of the shipping pallet.

6. The container of claim 1, further comprising:

a plurality of handles that are disposed along the side walls.

7. The container of claim 1, wherein the main body is constructed from recycled plastic that is blended with fire retardant additives.

8. The container of claim 1, wherein the container body includes a shape and dimension that is suitable for being stacked within a second container body.

9. The container of claim 1, wherein each of the side walls are tapered, and a dimension of the bottom end is greater than a dimension of the closed top end.

10. The container of claim 1, wherein the closed top end of the container body is flat, and each of the side walls are constructed to support vertical stacking of a second container body and pallet.

11. The container of claim 1, wherein the closed top end of the container body is not flat, so as to prevent vertical stacking of a second container body and pallet.

12. The container of claim 1, wherein the top end and the plurality of side walls are insulated.

13. A cover comprising:

a top wall;

a plurality of side walls;

an open bottom end; and a plurality of grooves that are positioned along a bottom edge of at least one of the side walls; and a plurality of protrusions extending from an outside surface of the closed top end, said plurality of protrusions forming a second plurality of grooves having a location that is complimentary to a location of the plurality of grooves, wherein said second plurality of grooves being configured to receive a forks of a forklift when the cover is in the inverted position, wherein the open bottom end includes a rectangular shape having dimensions that are complementary to a dimension of a shipping pallet, wherein each of the plurality of grooves include locations that are complementary to a location of a fork channel on the shipping pallet, wherein the top wall and the plurality of side wall define a hollow interior space, and wherein the top wall and the plurality of side walls are permanently joined together and include functionality for operating in an inverted position wherein a plurality of objects are stored on an inside surface of the closed top end within the interior space.

14. The container of claim 13, wherein the top wall and the plurality of side walls are insulated.

* * * * *